United States Patent [19]

Kaufmann et al.

[11] 4,180,319

[45] Dec. 25, 1979

[54] COPYING ARRANGEMENT

[75] Inventors: Heinrich Kaufmann, Stuttgart; Kurt Moser, Gerlingen, both of Fed. Rep. of Germany

[73] Assignee: Fa. Develop KG, Dr. Eisgein & Co., Fed. Rep. of Germany

[21] Appl. No.: 770,071

[22] Filed: Feb. 18, 1977

[30] Foreign Application Priority Data

Feb. 18, 1976 [DE] Fed. Rep. of Germany ..... 2606458

[51] Int. Cl.[2] ..... G03G 15/00

[52] U.S. Cl. ..... 355/3 R; 271/118; 355/3 SH; 355/16

[58] Field of Search ..... 355/3 R, 11, 16, 10, 355/15, 3 CH, 3 SH; 271/118, 127; 250/324, 325

[56] References Cited

U.S. PATENT DOCUMENTS

| | | | |
|---|---|---|---|
| 3,698,804 | 10/1972 | Cranskens et al. | 355/3 SH |
| 3,738,743 | 6/1973 | Hoffman et al. | 355/3 SH |
| 3,966,316 | 6/1976 | Pfeifer et al. | 355/3 DR |
| 3,997,262 | 12/1976 | Doi et al. | 355/3 R X |

*Primary Examiner*—R. L. Moses

*Attorney, Agent, or Firm*—Craig and Antonelli

[57] ABSTRACT

A photocopying arrangement which includes a bi partite housing accommodating a paper feeding unit, a corona discharge unit, an exposure station associated with an optical system to transfer an image of an original disposed on an exposure carriage, and a developing unit following the exposure station. The exposure carriage and the optical system are arranged in an upper housing section which is removable so as to uncover the entire paper flow. A bottom housing section, opened toward the top, accommodates the paper feeding unit, the corona discharge unit, the exposure station and the developing unit.

84 Claims, 7 Drawing Figures

FIG. 2
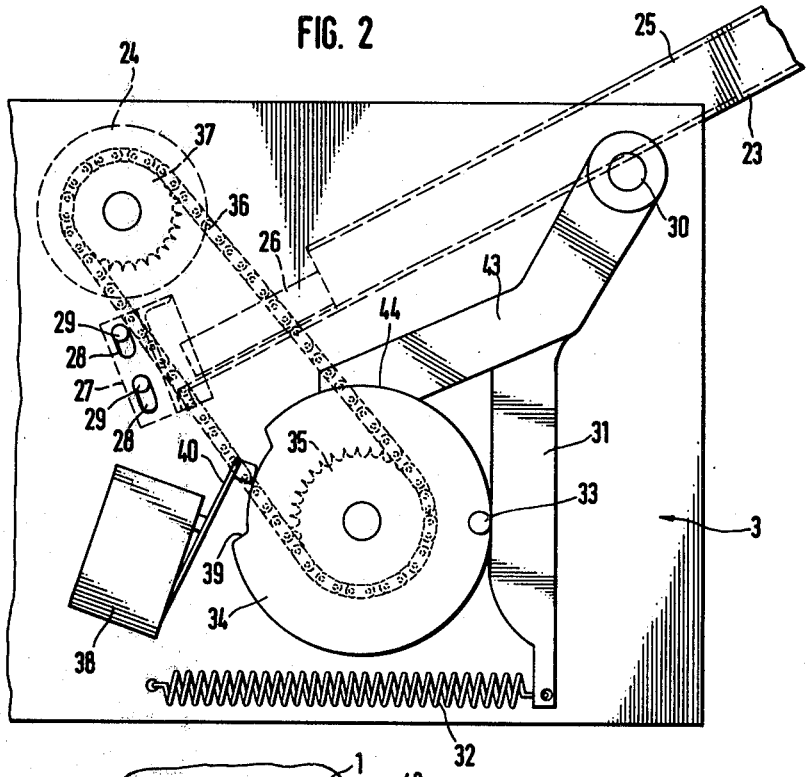
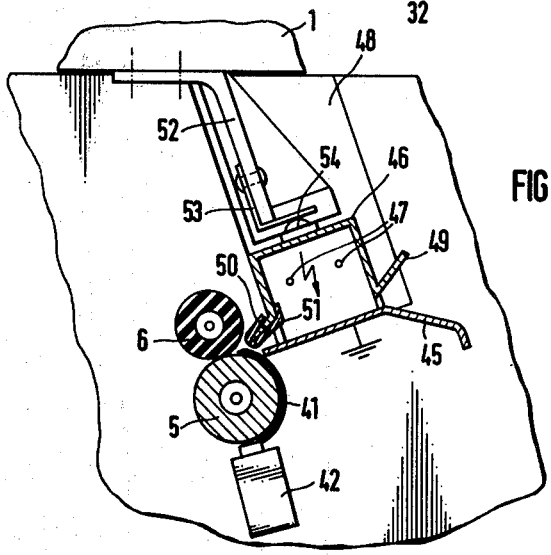
FIG. 3

COPYING ARRANGEMENT

The present invention relates to a copying arrangement and, more particularly, to a photocopying arrangement which includes a housing in which is accommodated a paper feeder, a corona discharge apparatus, an exposure station associated with an optical system to transfer an image of an original disposed on an exposure carriage, and a developing unit arranged upstream of the exposure station.

Copying arrangements of the afore-mentioned type have been proposed; however, the proposed arrangements are generally rather complicated in their construction, thereby resulting in a relatively high initial investment and necessitating, in general, a complicated servicing and/or, in many cases, repair operations that require especially highly trained service personnel which are made available by the manufacturers of the copying arrangements.

The aim underlying the present invention essentially resides in providing a copying arrangement of the aforementioned type which can be manufactured in a maximally economical manner and can be serviced simply and easily without trained personnel, with the paper flow as well as other parts to be serviced and/or the parts most susceptible to breakdowns or disturbances being readily accessible and easily cleanable with such parts being installable and/or removable without any difficulties.

In accordance with one feature of the present invention, an exposure carriage and an optical system are associated with a lid-type upper section of a housing which can be moved away from a housing bottom section, opened toward the top, which accommodates a paper feeder, a corona discharge unit, an exposure station, and a developing unit, whereby the entire run of paper flow is exposed.

By virtue of the construction of the present invention, the entire paper flow is immediately rendered accessible after moving the upper section of the housing and the units arranged therein away from the bottom section of the housing so that no difficulties are encountered, even by unskilled personnel, in eliminating any paper jam or other breakdown which may have occurred. Furthermore, it is then easier for such unskilled personnel to detect whether a certain part, and which part, of the copying arrangement may have been the cause of the paper jam and/or other failure. The affected parts can then be reached very simply through the lower housing section which is open at the top so that such parts can optionally be serviced and/or taken out and replaced by the unskilled personnel. Moreover, by virtue of the divided structure of the housing according to the present invention, it is possible to fashion a plurality of individual units of the copying apparatus in a particularly simple manner and mount them in a simple way so that, in total, a simplified manufacture of the copier and, accordingly, a substantial reduction in the manufacturing costs are realized.

According to a further feature of the present invention, a circuit breaker is disposed in an electrical supply line to the individual components of the copying arrangement, which components must be supplied with an electric current. Preferably, the circuit breaker is arranged between the upper section and bottom section of the housing so that the current supply is immediately interrupted when the housing is opened. Such an interruption of current supply is extremely significant when assuming that servicing operations or the like are performed by unskilled personnel since the person conducting the servicing work need not observe any safety rules since the electrical devices are automatically turned off or deactivated when the housing is opened.

According to yet another feature of the present invention, a paper feeder is provided which includes a supporting plate for supporting a paper stack projecting out of the housing. The supporting plate may be associated, in an approximately radial direction, with a feed roller construction for feeding paper from the stack. A drive mechanism is provided for the respective adjustment of the supporting plate with a start button or switch being provided for selectively turning the drive mechanism off and on. By virtue of this construction, a very simple mechanism is provided for the paper feed of the copying arrangement. Moreover, it is very simple to replenish the paper in the stack since the paper stack is located at a predetermined spacing or distance from the feed roller when the supporting plate is in a non-use or inoperative position.

One advantage of the paper feeder arrangement according to the present invention resides in the fact that the drive action for the feed roller may be derived from the drive mechanism for the adjustment of the supporting plate, whereby it is possible to simultaneously provide an effective drive for the adjustment unit and the feed roller without the provision of additional control means.

According to a still further feature of the present invention, a corona discharge apparatus is provided which includes a U-shaped casing which receives or accommodates wires or supply lines to be connected to a voltage or power source. The casing is provided with an open side arranged oppositely to a guide or baffle plate connected to ground. The corona discharge apparatus is of a very simple construction and yet perfectly fulfills its intended purpose. Advantageously, the corona discharge apparatus casing is introduced into a downwardly open slotted guide in the walls of the bottom section of the housing of the copying apparatus with lateral edges of the casing resting on the guide or baffle plate and with the casing being pressed against the guide or baffle plate by load-exerting elements of the upper section of the housing. Consequently, the corona discharge apparatus of the present invention is readily accessible once the upper housing section is moved away and such apparatus can readily be removed for testing and/or replacement.

In accordance with yet another feature of the present invention, a developing apparatus is provided which includes a trough-shaped container for accommodating a developer fluid with the container, together with all of the elements of the developing unit, being constructed as an independent component or module which can be pulled out of the bottom housing section of the copying apparatus at an end face thereof in the manner of a drawer. By virtue of this arrangement, the developing component or module is very easily accessible for servicing work such as, for example, the replenishing of the developer fluid and/or the use of a new storage container with the developer fluid as a replacement, or like operations. Likewise, in the same manner, any cleaning operations which may become necessary in the area of the developing apparatus are easily performed.

According to yet a further feature of the present invention, an optical system is provided which includes a lamp inserted from one side in the upper housing section of the copying arrangement with the lamp being held by a resilient contact element in an opposite socket producing an electrical contact, whereby the replacement of the lamp may be effected in an extremely simple manner.

In accordance with another feature of the present invention, an exposure carriage, constituting a top side of the upper housing section, is provided with a glass plate guided on one side along a wall of the upper housing section by a telescopic pull-out arrangement and, on the other side, by a track or slide bar. By virtue of these constructional features, a very simple and inexpensive exposure carriage results which functions flawlessly. Moreover, this construction provides the advantage that canting of the exposure carriage is impossible due to the unilateral forced guidance and track arranged on the other side of the exposure carriage. Therefore, the glass plate of the exposure carriage is stressed only to a minor extent, whereby the glass plate generally need not be enclosed in a special hard frame.

Accordingly, it is an object of the present invention to provide a copying arrangement which avoids by simple means the shortcomings and drawbacks encountered in the prior art.

A further object of the present invention resides in providing a copying arrangement which, in total, is inexpensive to manufacture and is readily serviceable by unskilled personnel.

Yet another object of the present invention resides in providing a copying arrangement which is fashioned of a plurality of individual components or modules, each of which are manufactured in a simple relatively inexpensive manner and each of which are easily serviceable.

These and other objects, features and advantages of the present invention will become more apparent from the following description when taken in connection with the accompanying drawings which show, for the purposes of illustration only, one embodiment in accordance with the present invention, and wherein:

FIG. 2 is a lateral view, on an enlarged scale, of a paper feeder apparatus of the copying arrangement of FIG. 1;

FIG. 3 is a lateral cross-sectional view, on an enlarged scale, of a corona discharge apparatus of the copying arrangement of FIG. 1;

Figure 1:
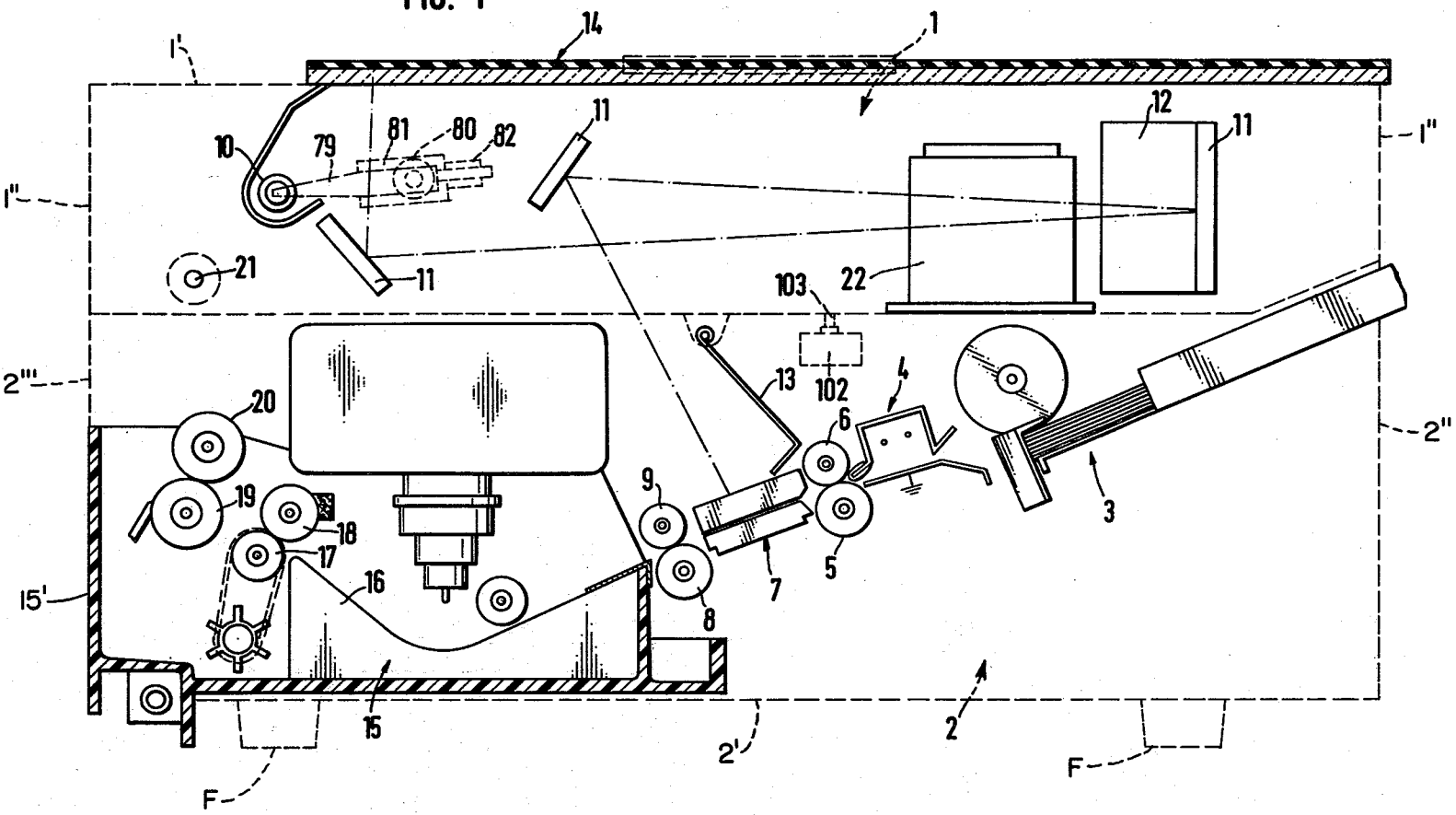
FIG. 1 is a schematic cross-sectional view of a copying arrangement in accordance with the present invention.

Referring now to the drawings, wherein like reference numerals are used throughout the various views to designate like parts and, more particularly, to FIG. 1, according to this figure, a bi partite housing is provided which includes an upper housing section generally designated by the reference numeral 1 and a lower housing section generally designated by the reference numeral 2, both of which are illustrated in phantom line. Paper for copying purposes is fed from a paper supply such as, for example, a stack of paper, by a paper feed mechanism generally designated by the reference numeral 3 disposed at the right-hand side of the housing. The paper is transported from the paper feed mechanism 3 through a corona discharge mechanism generally designated by the reference numeral 4 after which a pair of conveying rollers 5, 6 seize or grip the arriving paper and guide the same through an exposure station generally designated by the reference numeral 7 to another pair of conveyor rollers 8, 9.

In the exposure station 7, an image is transferred to the travelling paper from an original, disposed on an exposure carriage, generally designated by the reference numeral 14, by way of an optical system which includes a lamp 10, mirror elements 11, an objective 12, and a light shutter or stop 13.

In operation, the original is received on the exposure carriage 14 which is displaced past the zone of a lamp 10 of the optical system at a speed corresponding to the speed of the paper transport in the zone of the exposure station 7. The pair of conveying rollers 8, 9 seize or grip the paper at the output of the exposure station 7 and transport the paper to a developing unit generally designated by the reference numeral 15 which, in the illustrated embodiment, is constructed as a liquid developer unit. The copies are passed on guide ribs 16 of the developing unit 15 to a pair of squeeze rolls 17, 18 and subsequently to a pair of drying rolls 19, 20 which deliver the produced copy from the copying arrangement.

As apparent from FIG. 1, the paper withdrawn for copying purposes from the paper supply is fed from the right-hand end face of the copying arrangement and is subsequently processed and issues, after a copying operation, at the left end face of the copying arrangement.

As shown in FIG. 1, the bottom housing section 2 accommodates the paper feeder 3, the corona discharge unit 4, the exposure station 7, and the developing unit 15, as well as the two pairs of conveying rolls 5, 6 and 8, 9, whereas the upper housing section 1 accommodates the elements of the optical systems, i.e., the lamp 10, the mirror system 11, the objective 12 and the light stop or shutter 13 in addition to the exposure carriage 14 arranged at the top side of the upper section 1.

The bottom housing section 2 is open at the top and closed by the upper housing section 1 such that, after the upper housing section 1 has been removed, all of the elements of the copying arrangement accommodated in the bottom housing section 2 become readily accessible from above to permit servicing or the like.

The upper housing section 1 is connected to the bottom housing section 2 by a swivel or pivot axle 21 located in the area at which the copies are issued, i.e., in the area of the developing unit 15. The upper housing section 1 can be flipped or pivoted open in the manner of a lid or cover about the pivot axle 21 to uncover the interior of the housing.

The developing unit 15 is constructed as an independent module which can be readily removed from the bottom housing section 2 and the fact that the upper housing section 1 is not completely removed in the zone of the developing unit 15 does not interfere with the removal operation of the developing unit 15. By pulling out the developing unit 15, all of the components of the unit can be readily made accessible for servicing or the replenishment of the developer fluid.

As readily apparent from the above description and the illustration of FIG. 1, the bottom housing section 2 includes a bottom wall 2', two spaced side walls, a first end wall 2'', and a second end wall 2'''. The side walls are provided with mounting elements (not shown) disposed on the interior of the bottom housing section, which mounting elements serve to support the elements of the paper feed mechanism 3, the corona transfer unit 4, exposure station 7 and conveyor rollers 5, 6 and 8, 9. The lead wires and supply lines as well as the drive elements for the mechanisms of the copying arrangement may be arranged on the outside of one or both of the side walls with an appropriate cover or enclosure (not shown) being mounted at the side walls for covering the wires, lines and/or drive elements from the outside.

Only the developing unit 15 is arranged completely between the side walls and the bottom housing section 2. While the arrangement of FIG. 1 provides a partial end wall 2''' at the bottom housing section 2, it is understood that the end wall 2''' may be dispensed with and the end wall 15' of the developing unit 15 may be extended so as to form the end wall of the bottom housing section 2.

The upper housing section 1 is constructed in the same manner as the bottom housing section 2 and includes a top wall 1', two spaced side walls, and two spaced end walls 1''. A frame (not shown), manufactured as an injection molded article, is provided at which the optical devices and other accessories such as, for example, a high voltage rectifier 22 for the corona discharge unit 4 are arranged. The drive elements for the exposure carriage 14 are disposed outside of the frame and are covered from the outside by a suitable casing or enclosure (not shown). Moreover, additional installations are arranged outside of the frame, for example, the electrical leads to the lamp 10 with such additional installations also being covered from the outside by suitable casing parts or enclosures (not shown).

As shown most clearly in FIG. 2, the paper feeder 3 includes a supporting plate 23 for receiving the copying paper to be introduced into the copying arrangement. The paper may, for example, consist of a paper coated with zinc oxide (ZnO). The supporting plate 23 has arranged thereon a stack of papers with the top sheet of the stack cooperating with a feed roller 24 which may consist of a single roll extending transversely through the copying arrangement or may be subdivided into two or more individual rollers mounted on at least one common shaft.

The supporting plate 23, projecting from above obliquely into the bottom housing section 2, is constructed as a guide means for receiving a cassette or the like of copying paper. For this purpose, the supporting plate 23 is advantageously provided with lateral guide flaps or lugs 25 which are angled at the top toward the center of the plate 23. The lateral guide flaps 25 terminate at a predetermined distance from the front edge of the supporting plate 23, disposed in the bottom housing section 2, so that the paper stack is uncovered on three sides if that portion of the cassette of copying paper is also removed. In order to laterally align the stack of paper, resilient plates or holders such as, for example, spring plates or lugs 26 are attached to the supporting plate 23 so as to extend at least from the front edge of the guide flaps 25 up to or in the area of the front edge of the supporting plate 23. The holders 26 compress the paper stack in the lateral direction and break and hold back sheets not directly seized or gripped by the feed roller 24.

A paper severing or cutting bar 27 is arranged adjacent the front edge of the supporting plate 23 with the bar 27 having a guide surface aligned approximately radially to the feed roller 24. The paper severing bar, in the marginal zone, has an approximately T-shaped cross-section so that it constitutes corner separators for the paper stack.

With the supporting plate 23 in the rest position shown in FIG. 2, a relatively large spacing exists between the supporting plate 23 and the feed roller 24 as well as the paper severing bar 27. The paper severing bar 27 is guided in an approximately radial direction movably in slotted holes 28 in a side wall of the bottom housing section 2 by means of pins 29. To effect a paper feeding operation, the supporting plate 23 must be aligned with the feed roller 24 and, for this purpose, the supporting plate 23 is mounted so as to be pivotable about an axle 30 such that the end edge of the supporting plate 23 which extends into the bottom housing section 2 is associated approximately radially with the feed roller 24. By pivoting the supporting plate 23 about the axle 30, the paper stack arranged thereon contacts the corner separators the paper severing bar 27. By virtue of this arrangement, it is ensured that the paper stack has a specific configuration and is under the load of the weight of the paper severing bar 27.

The alignment of the supporting plate 23 with the feed roller 24 is effected by a rocking lever 31 connecting by the axle 30 for rotation with the supporting plate 23. The rocking lever 31 is resiliently loaded by a resilient element such as, for example, a spring 32, and is pulled against a pin 33 of a cam disk 34. Upon rotation of the cam disk from the position illustrated in FIG. 2, the pin 33 releases the rocking lever 31 so that the spring 32 moves the supporting plate 23 toward the feed roller 24 by way of the lever 31.

As the cam disk 34 continues to rotate, the pin 33 continues to be displaced until it again enters the zone or area of the rocking lever 31 and entrains the latter and adjusts the same against the force of spring 32 so that the supporting plate 23 is again moved away from the feed roller 24. The supporting plate 23 needs to remain, with its end edge, in the zone of the feed roller 24 only until the pulled or drawn off sheet has been seized or firmly gripped by the subsequent pair of conveyor rolls 5, 6. After the pair of conveyor rolls 5, 6 take over the further transportation of the paper, the supporting plate 23 can move back again to the rest position illustrated in FIG. 2.

The displacement of the supporting plate 23 is also controlled by the fact that the cam disk 34, driven by an electric motor (not shown), drives, by a sprocket wheel 35, connected for rotation with the cam disk, and by a chain 36, a sprocket wheel 37 connected with the feed roller 24 with the translation between the sprocket wheels 35, 37 being selected so that one rotation of the cam disk 34 and also the sprocket wheel 35 is sufficient to effect by means of the feed rollers 24 a paper feeding step to the subsequent pair of conveyor rolls 5, 6.

The paper feeder 3 is actuated or turned on by a start button (not shown) so as to activate the drive motor of the cam disk such that the supporting plate 23 is aligned with the feed roller 24 which, in turn, is driven to effect a paper feeding operation. The duration of operation of the drive motor is determined by the configuration of the cam disk 34 even after the start button itself has been released. For this purpose, a sensor switch 38 is associated with the cam disk 34 with the switch 38 maintaining the drive motor in operation until a recess 39 of the cam disk 34 passes, after one revolution, back into the zone or area of the feeler 40 at which point the drive motor is deactivated and the further transportation of the paper is performed by the pair of conveying rolls 5, 6.

So as to ensure the activation of the drive of the pair of conveyor rolls 5, 6 when the drive motor of the cam disk is deactivated, a sensor switch (FIG. 3) is associated with the drive of the conveyor rolls 5, 6 with the switch 42 being actuated by the front edge of an arriving sheet of paper through a ring 41. The sensor switch 42, upon actuation, automatically starts the primary drive of the copying arrangement, i.e., the drive of the conveyor roll pairs 5, 6 and 8, 9, as well as the drive of the squeeze rolls 17, 18 and the drying rolls 19, 20.

To ensure that the cam disk 34 returns to a standstill in the basic or rest position shown in FIG. 2 after executing one revolution, the rocking lever 31 is provided with a brake arm 43 which, in the illustrated rest position, contacts with a brake surface 44 provided at the circumference of the cam disk 34. The brake arm 43 and brake surface 44 brake the cam disk 34 so that the pin 33 cannot travel beyond the range or zone of the rocking lever 31 after the cam disk 34 executes one revolution.

Since the supporting plate 23 in the rest position shown in FIG. 2 maintains a predetermined spacing from the feed roller 24 and from the paper severing bar 27, no difficulties are encountered in exactly inserting a stack of paper and/or a cassette of paper, and any damage to and/or deformation of the front edges of the externally disposed sheets of the paper stack is prevented with certainty.

The sheets from the paper feeder 3 are conveyed to an adjoining corona discharge unit 4 at such an angle that the sheets safely contact with their reverse or back sides a baffle 45 connected to ground. As shown most clearly in FIG. 3, the baffle 45 is arranged oppositely to a housing or corona shell 46 which accommodates corona wires 47 to which a voltage is applied. A corona shell 46 is inserted from above the bottom housing section 2 in an oblique slotted guide 48, opened toward the top, provided in the side walls of the bottom housing section 2. The corona shell 46 rests with its lateral insulated edges on the baffle 45 and is secured against lateral shifting. The corona shell 46 has a U-shaped cross-section which, in the assembled position, opens toward the baffle 45. The front edge or guide surface 49 of the corona shell 46 is fashioned so as to diverge obliquely in the upward direction such that a narrow gap 55 is defined between the guide surface 49 and the baffle 45, whereby an arriving sheet of paper is securely guided through the corona shell 46 and exits through a gap 55' defined between the baffle 45 and the rear edge 50 of the corona shell 46 without entering the zone of the corona wires 47. Consequently, the corona shell 46 need not be equipped with a mesh of nylon threads or the like to prevent the paper from contacting the corona wires 47.

The rear edge 50 of the corona shell 46 is provided with an insulating layer 51 suitably secured thereto by, for example, an adhesive such as glue or the like so that a discharge of the charged layer of the paper as well as a spark-over or arcing of the corona shell 46 to the baffle 45 and/or the steel roller 5 of the conveyor rolls 5, 6 at the narrowest point is avoided. A layer of varnish applied, for example, by dipping the rear edge 50 into a bath may also serve as providing a layer of insulation at the rear edge 50. The conveying direction of the paper, determined by the baffle 45 and the rear edge 50 of the corona shell 46, is selected so that the arriving paper impinges on the steel roller 5 cooperating with the rubber roller 6 and/or on the ring 41 of the sensor switch 42, which ring at least partially surrounds the steel roller 5.

To press the corona shell 46 into an operating position when the housing of the copying arrangement is closed, weighting elements 52 are attached to the upper housing section 1. The weighting elements 52 are provided with resilient contact members 53 which engage, during a closing of the housing, corresponding contacts 54 of the corona shell 46 to establish a connection between the corona discharge unit 4 and the high frequency generator or high voltage rectifier 22 arranged in the upper housing section 1.

Figure 4:
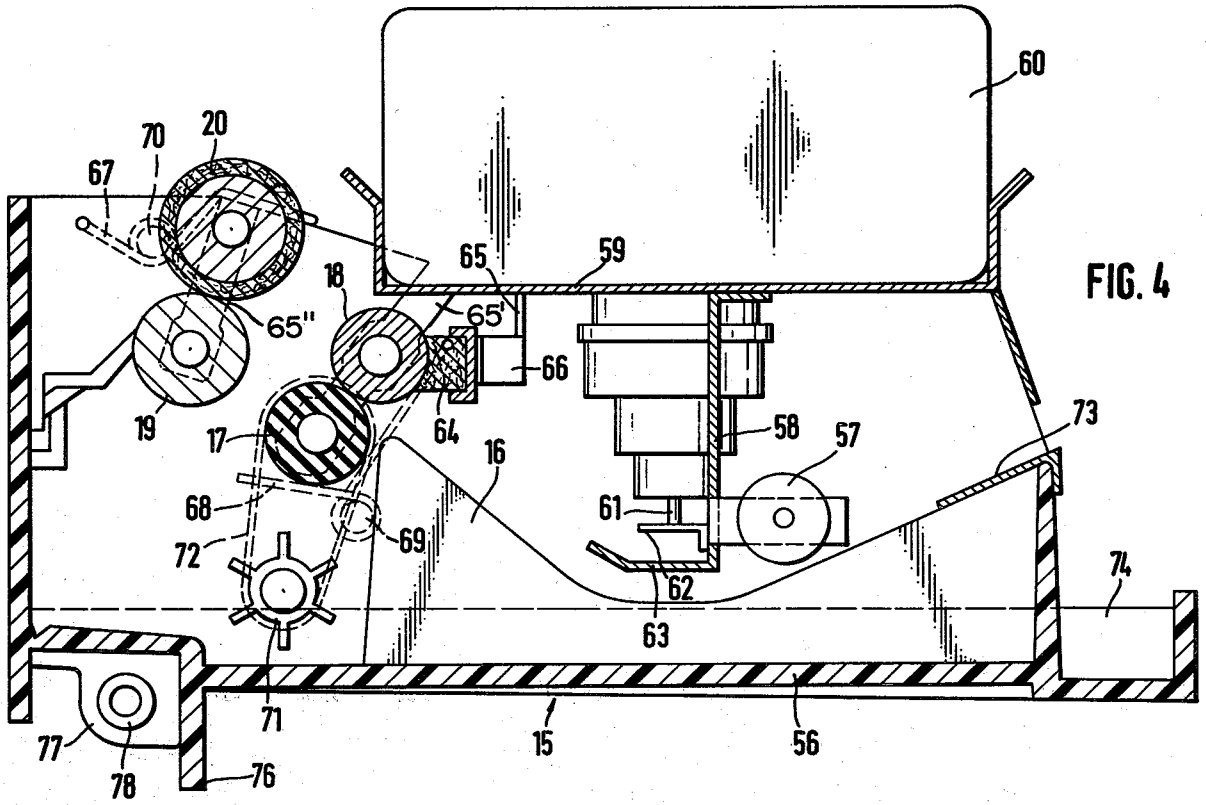
FIG. 4 is a lateral cross-sectional view, on an enlarged scale, of a developing apparatus for the copying arrangement of FIG. 1.

From the corona discharge unit 4, the paper, transported by the pairs of conveyor rolls 5, 6 passes through the exposure station 7 and is transported by conveyor rollers 8, 9 to the developing unit 15. As shown in FIG. 4, the developing unit 15 includes a trough-shaped container 56 for accommodating a developer fluid. The container is constructed so as to ensure that a long travel path for the paper is obtained while permitting the use of smaller paper formats. Guide ribs 16, projecting from the bottom of the container 56, are provided and begin at the front edge of the container 56 facing the exposure station 7 and/or the pair of conveying rolls 8, 9 with the guide ribs 16 being initially inclined downwardly at an angle of about 25° and extending beneath and beyond a guide roll 57. The guide ribs 16 extend or are inclined upwardly in a zone or area disposed upstream of the guide roll 57 so that paper being transported through the developing unit 15 is guided into, through and out of the bath of the developer fluid.

The guide roll 57 functions as an electrode for effecting a voltage gradient toward the charged side of the paper so as to effect an improved precipitation of the toner particles in the developer fluid. The guide roll 57 may be connected to ground or to a specific potential. Preferably, the guide roll 57 is constructed of aluminum or an aluminum alloy and is provided with a surface profiled so as to define a pyramidal pattern. A mounting plate 58 arranged at a holding structure 59 mounts the guide roll 57 with a storage tank 60, accommodating the developer fluid, being held so that a valve 61 of the tank 60 is immersed in the developer fluid disposed in the container 56. A valve plate or sheet 62 is provided for maintaining the valve 61 in an open position.

The storage tank 60 is suitably secured at the holding structure 59 by a resilient member such as, for example, a spring element (not shown) or the like such that the tank 60 cannot move on its own into a position wherein the valve 61 would be closed. The holder 58 for the guide roll 57 and the valve plate 62 form a guide rail 63 located in the area of the lowest point of the guide ribs 16 so as to force the paper to travel through the lowest point. The holding structure 59, by virtue of its disposition above the container 56, functions as a large-area cover for the container 56 so that the evaporation of the developer fluid is greatly inhibited.

A pair of squeeze or drying rolls 17, 18 is arranged adjacent to the guide ribs 16 with a wiper element 64 such as, for example, felt or the like, being provided for the squeeze roll 18 which contacts the top or image side of the copy. The roll 18 is constructed as a polished steel roll and the wiper element 64 is pressed against the squeeze roll 18 by means of a resilient element such as, for example, a leaf spring 66 arranged in a slotted guide 65 provided in side walls of the container 56, whereby offset phenomena are avoided. The slotted guides 65 of the container side walls prevent a twisting of the wiper element 64.

A further pair of drying rolls 19, 20 is arranged upstream of the squeeze rolls 17, 18 for achieving a further drying effect with the roll 20 facing the coated side or picture side of the paper being coated with an absorbent material such as, for example, a blotting paper. The drying rolls 19, 20 are arranged such that the paper has a conveying direction at a smaller angle than the inclination of the squeeze rolls 17, 18 with respect to the vertical so that the paper does not exit from the developing unit 15 at too steep an angle.

The respective pair of squeeze rolls 17, 18 and drying rolls 19, 20 are urged toward each other by resilient elements such as, for example, springs 67, 68, respectively. The squeeze rolls 17, 18 and drying rolls 19, 20 are introduced with their bearings from above the bottom housing section 2 into slots 65', 65" provided in the container side walls and are under the effect of an arm of springs 67, 68. The arms of the springs 67, 68 are bent from spring wire with each loop being disposed about a trunion 69, 70, respectively, attached or arranged on the outside to the side walls of the container with the other end of each of the springs 67, 68 being fixedly mounted in a bore of the container wall.

A star or paddle roller 71 is mounted in the interior of the container 56 of the developing unit 15 below the liquid level so that it is unnecessary to seal the bearing points toward the outside. The star roller 71 is driven by a resilient element such as, for example, a coil spring 72 looped in the manner of a strip around the star roller 71 and the squeeze rolls 17, whereby the star roller 71 stirs the developer fluid so that toner particles therein are unable to settle in the container 56.

The front edge of the container 56 facing the pair of conveying rolls 8, 9 is arranged so as to be relatively low, whereby a flawless entry of the paper from the conveyor rolls 8, 9 can readily be achieved. A cover sheet 73 extending over at least a portion of the guide ribs 16 in the zone of the front edge of the container 56 is provided for preventing a spilling of the developer fluid in case of vibrations of the copying arrangement or the like. Moreover, an overflow trough 74 having a front wall and two side walls encloses the front edge of the container 56, whereby any spilled developer fluid can evaporate.

The bottom of the container 56 is slightly inclined beginning in the area of the star roller 71 in the forward as well as the rearward directions so that the developer fluid can be thoroughly stirred by the star roller 71 in this area. The bottom of the container 56 is provided on its outside with a transverse rib 76 which projects, when the developing unit is inserted in the bottom housing section 2 (see FIG. 1) downwardly from the bottom wall 2" which is recessed from that point up to the end of the bottom housing section 2. The transverse rib 76 has a height which is approximately equal to the height of the feed F (FIG. 1) of the bottom housing section 2 plus the thickness of the bottom wall 2" so that the container 56 of the developing unit 15, when pulled out of the bottom housing section 2, can be placed with the transverse rib 76 on a table surface or the like and yet retain approximately its horizontal position during such step.

An indentation 77, arranged laterally in the container bottom, is provided in the area of the transverse rib 76 with a connecting nipple 78 being provided at the indentation for receiving a hose (not shown) which may be plugged by a stopper (not shown) or the like and held by spring clips (not shown), during normal operation, in parallel to the transverse rib 76. It is possible by virtue of the hose to drain the developer fluid from the container 56 of the developing unit 15 for the purposes of transporting the apparatus or the like.

Lamp 10, partially visible in FIG. 1, is introduced from the side of the housing into the frame of the upper housing section 1. A socket (not shown) is provided for receiving one end of the lamp 10 and establishing an electrical contact with a conical insulating member of a synthetic resinous material leading to the socket to facilitate the insertion of the lamp 10. On the other side of the upper housing section 1, the side visible in FIG. 1, the lamp 10 is held by a resilient contact element 79 clamped by a knurled-head screw 80 to an insulating member 81 attached to the upper housing section 1. The resilient contact element 79 is fashioned as a contact lug for receiving a plug 82 or the like which serves as the current supply for the lamp 10.

Figure 5:
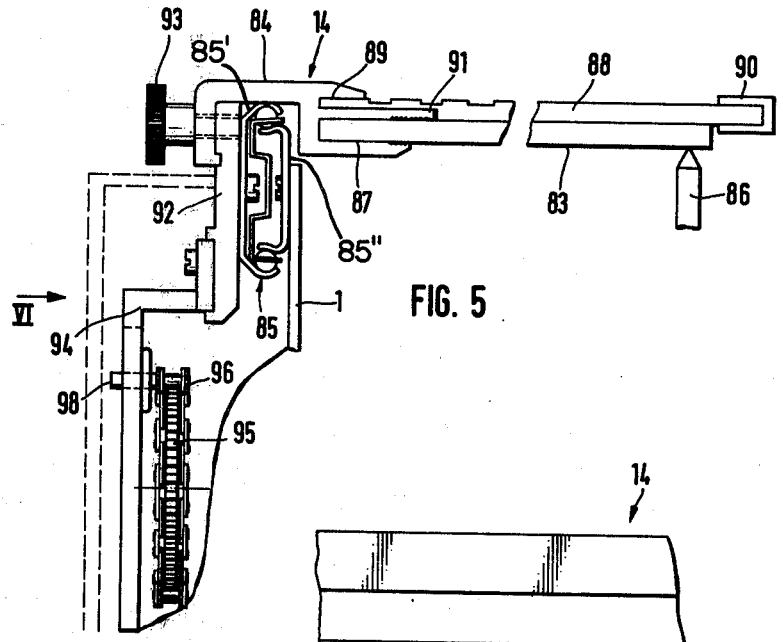
FIG. 5 is an enlarged detail view in the area of the exposure carriage in the copying arrangement of FIG. 1.
Figure 6:
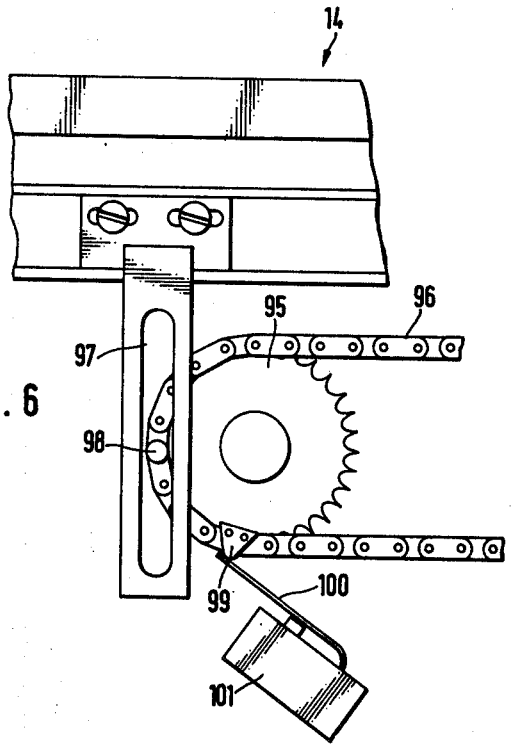
FIG. 6 is a partial view taken in the direction of arrow VI in FIG. 5.

As shown in FIGS. 5 and 6, the exposure carriage 14 defines the top or upper limits of the housing section 1 and includes a glass plate 83 having one lateral edge enclosed by a profile or strip 84 which is connected with one part 85' of a telescoping pullout device generally designated by the reference numeral 85, the other part 85" of which is arranged in the area of the top edge of the side wall of the upper housing section 1. The glass plate 83, not enclosed by a frame or the like, rests in the area of its opposite lateral edge on a guide track 86 constructed of a synthetic resinous material. The track 86 is constructed as a support which tapers in the manner of a blade with the track being mounted in the region of the opposite side wall of the upper housing section 1.

The glass plate 83 is arranged in a U-shaped mounting slot 87 of the profiled strip 84 and is secured at the slot 87 by a suitable adhesive such as glue or the like. A rubber cover 88 has one end or rim thereof arranged in a further U-shaped mounting slot 89 provided in the profiled strip 84 with the cover being secured in the slot 89 by, for example, a suitable adhesive such as glue or the like.

The rubber cover is constructed so as to be thinner in the area of the mounting slot 89 and, if desired, may be profiled at least in the area of the slot 89. The cover 88 is adapted to be flipped or pivoted in the manner of a lid or top so that an original may be arranged on the glass plate 83 and subsequently covered by the rubber cover 88. A strip-shaped handle 90 encloses a lateral zone of the rubber top 88 which projects beyond the glass plate 83. A rim 91 is defined by a portion arranged between the U-shaped slots 87, 89 with the end of the rim 91 projecting beyond the end faces of the upper and lower end faces of the elements defining the upper and lower portions of the slots 87, 89, respectively. The rim 91 extends over a portion of the glass plate 83 and is adapted to be uncovered by a pivoting of the rubber cover 88, whereby the rim 91 may be employed as an abutment edge for the original. Preferably, the rim is provided with corresponding markings (not shown) to facilitate alignment of the original on the glass plate 83.

The profiled strip 84 is attached to a profiled bar 92 at which is fixedly arranged the movable part 85' of the telescoping pull-out device 85. A connection between the profiled strip 84 and profiled bar 92 is obtained by providing knurled-head screws 93, whereby after loosening of such screws, the profiled strip 84 may be removed with the glass plate 83 and the rubber cover 88, thereby substantially facilitating the cleaning of the glass plate especially on the underside thereof.

A pushing or displacement lever 94 is arranged at and attached to the profiled bar 92, whereby the exposure carriage 14 may be shifted by way of a chain drive which includes two sprocket wheels 95, only one of which is illustrated in FIGS. 5 and 6, supported at the upper housing section 1. The sprocket wheels 95 are connected with each other by way of an endless chain 96 having a conveying direction which extends in parallel to the displacement direction of the telescoping pull-out device 85, that is, toward the top edge of the upper housing section 1. The non-illustrated sprocket wheel is arranged coaxially to the pivot axle 21 (FIG. 1) which pivotally connects the upper housing section 1 and the bottom housing section 2 with such sprocket wheel being driven by a chain drive (not shown) operatively connected with the drive means for the conveyor rolls 5, 6 and 8, 9.

The pushing or displacement lever 94 is provided with a slotted hole 97, engaged by an entrainment pin 98 provided on the chain 96, with the slotted hole 97 being dimensioned so that it corresponds to at least the diameter of the sprocket wheels 95 and/or the spacing of two runs in the endless chain 96. The chain drive of the endless chain 96 and/or the exposure carriage 14 is arranged with respect to each other so that, in an initial position shown in FIG. 6, the entrainment pin 98 of the chain 96 is arranged horizontally adjacent the axis of the sprocket wheel 95, whereby upon a displacement of the entrainment pin 98, the exposure carriage 14 is gently set into operation.

To ensure that the exposure carriage 14 is always arrested or stopped in the initial position shown in FIG. 6, independently of other operating conditions, the chain 96 is provided with a cam element 99 associated with a feeler 100 of a limit switch 101. Upon actuation by the cam 99, the limit switch 101 inactivates the main drive mechanism of the copying arrangement.

The developing unit 15 is fashioned so as to be insertable into the bottom housing section 2 in the manner of a drawer with the squeeze rollers 17, 18 and drying rolls 19, 20 being automatically brought into engagement with the drive means of the copying arrangement upon the introduction of the container 56 into the bottom housing section 2. For this purpose, at least one gear wheel (not shown) is mounted at the side wall of the bottom housing section 2 so as to be fixed with respect thereto and rotatable by the copying arrangement drive means (not shown). Preferably, the squeeze roller 18 is provided with a gear wheel (not shown) arranged on the outside of the container 56, which gear wheel is adapted to engage the at least one gear wheel provided at the bottom housing section 2. The gear wheel of the squeeze roller 18 is directly engageable with a gear wheel (not shown) provided on the drying roll 19. Alternatively, at least one further gear wheel (not shown) may be interposed between the gear wheels of the squeeze roller 18 and the drying roll 19 to operatively connect the same.

The at least one gear wheel provided at the bottom housing section 2 may be associated with a gear wheel (not shown) arranged at the squeeze roller 17 and, if such is the case and the at least one gear wheel is being driven by the drive means, then a force component effective on the entire container 56 results by virtue of the conveying direction of the squeeze roller 17, which force component tends to pull the container 56 into the bottom housing section 2, whereby it is possible to securely mount the developing unit in the bottom housing section without the need of additional securing means. However, a fish plate (not shown) provided with an overload spring (not shown) may be arranged in the bottom housing section for pressing the inserted container 56 therein so that, even if the gear wheels which are to mesh should initially contact each other with two teeth, a locking action takes place after a minor rotation of the driven gear wheel.

To provide for an automatic immediate interruption of the power supply to the copying arrangement upon an opening of the housing, as shown in FIG. 1, a circuit breaker 102 is arranged, for example, at the bottom housing section 2, which circuit breaker is actuated by an extension 103 arranged at the upper housing section 1. The extension 103 is preferably a part of a cover which laterally closes the upper housing section and the circuit breaker 102 is connected in the electrical supply line in front of all loads and is switched to be conductive or operative by the extension 103. After opening of the housing by pivoting away the upper housing section 1, the current supply to all loads is immediately interrupted as becomes more apparent from the circuit diagram of FIG. 7.

Figure 7:
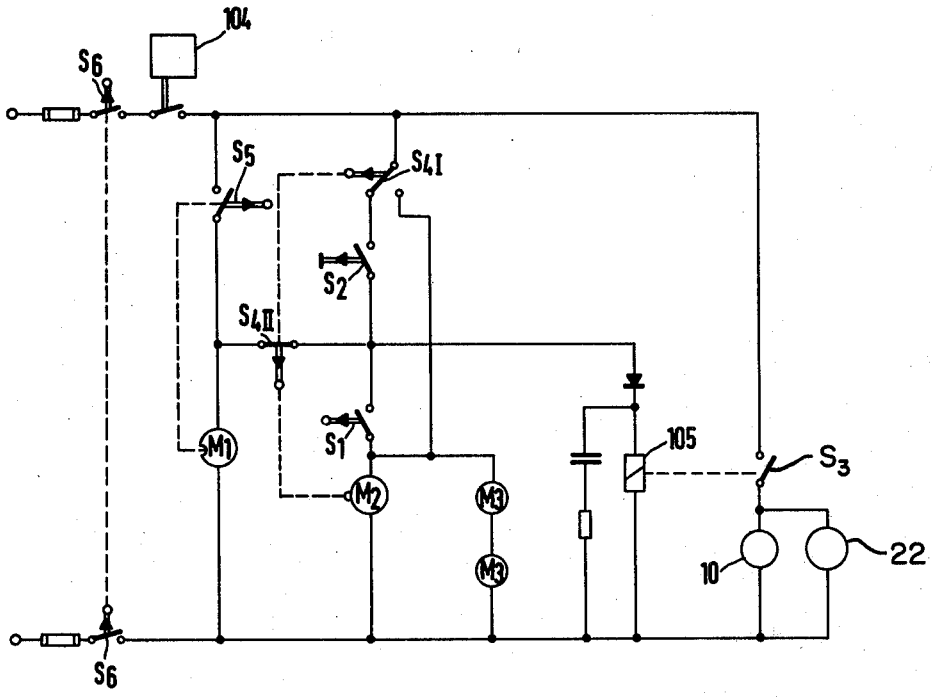
FIG. 7 is an electric circuit diagram for the control of the copying arrangement of FIG. 1.

As shown in FIG. 7, the circuit breaker 102, designated by the reference character $S_6$, is disposed behind both fuses in both phases of the current supply system with a thermal-lag switch 104 being arranged in one of the phases. The drive motor $M_1$ of the cam disk 34 is connected to the current supply and is activated by the actuation of the start button $S_2$, whereby the cam disk 34 commences rotation. The rotation of the cam disk 34 activates the switch $S_5$ (38 in FIG. 2) so that the drive motor $M_1$ remains in operation.

With the actuation of the start button $S_2$, a switch $S_3$ is likewise closed by way of a relay 105 so as to supply power to the lamp 10 and the high voltage rectifier 22. The paper travelling through the corona discharge unit 4 activates the switch $S_1$ (42 in FIG. 3) which activates the main drive motor $M_2$ of the copying arrangement and two motors $M_3$ are provided for driving fans for cooling the lamp 10.

Together with the activation of the main drive motor $M_2$, the exposure carriage 14 is likewise activated and displaced so that the switches $S_{4I}$ and $S_{4II}$ (101 in FIG. 6) are activated by the chain 96 provided with the cam 99 so that the motors $M_2$, $M_3$ remain in operation. The current supply to the drive motor $M_1$ of the cam disk 34 continues until the feeler 40 engages in the recess 39 of the cam disk 34. As the paper exits from the pair of conveyor rolls 5, 6, the switch $S_1$ is released or opened. Thereafter, the relay 105 is inactivated with a preset delay so that the lamp 10 and the high voltage rectifier 22 are deactivated or turned off. As long as the switch $S_{4I}$ remains closed, the main drive motor $M_2$ remains in operation so that the exposure carriage 14 is returned into the initial position, at which point the switch $S_{4I}$ switches over into the position shown in FIG. 7 so that then the main drive motor $M_2$ and the fan motors $M_3$ are deactivated, whereby the copying arrangement is then in the rest position and ready for a new copying operation.

A paper collecting basket (not shown) may be hingedly suspended in eyes (not shown) arranged in the upper housing section 1 with the basket being additionally supported at the bottom housing section 2. By virtue of this construction, it is possible to open the housing without removing the paper collecting basket since the latter may be moved away from the housing by a pivoting action.

As readily apparent from the above description, the respective units of the copying arrangement of the present invention, for example, the paper feeder 3, the corona discharge unit 4, the developing station 5, and the exposure carriage 14 may, of course, be advantageously utilized individually in copying arrangements of different constructions.

While we have shown and described only one embodiment in accordance with the present invention, it is understood that the same is not limited thereto, but is susceptible of numerous changes and modifications as known to those skilled in the art, and we therefor do not wish to be limited to the details shown and described herein, but intend to cover all such changes and modifications as are encompassed by the scope of the appended claims.

We claim:

1. A copying arrangement which includes a housing means, a paper feeder means for feeding a sheet of copying paper upon which an image is to be transferred, a corona discharge means, an exposure station means associated with an optical system for transferring an image of an original arranged on an exposure carriage means, and a developing means arranged downstream of the exposure station means, characterized in that said housing means includes an upper housing section and a lower housing section, said lower housing section is open toward the top and accommodates at least the paper feeding means, the corona discharge means, the exposure station means and the developing means, the upper housing section accommodates at least the exposure carriage means and the optical system with said upper housing section being removable so as to uncover an entire flow path of the copying paper, the paper feeder means includes a means for supporting a stack of copying paper, feed roller means for selectively engaging and feeding a sheet of copying paper from the stack, means for aligning said supporting means in an approximately radial direction with respect to said feed roller means wherein said support means is moved from a non-operative to an operative position so as to enable said sheet of copying paper to be fed from said stack, and means for selectively activating said aligning means.

2. A copying arrangement according to claim 1, characterized in that means are provided for pivotally mounting said upper housing section to said lower housing section such that said upper housing section may be pivoted in an upward direction away from the lower housing section to an open position.

3. A copying arrangement according to claim 2, characterized in that said means for pivotally mounting said upper housing section to said lower housing section includes a pivot axle extending transversely to a transport direction of the sheet of copying paper, said pivot axle being arranged at the end face of the housing means at which a completed copy issues.

4. A copying arrangement according to claim 3, characterized in that said pivot axle is arranged in an area of the developing means.

5. A copying arrangement according to claim 1, characterized in that said developing means is constructed as an independent completely functional module removable from said lower housing section.

6. A copying arrangement according to claim 5, characterized in that means are provided for interrupting a supply of current from an electrical supply line to the copying arrangement upon a pivoting of the upper housing section into an open position.

7. A copying arrangement according to claim 1, characterized in that the developing means includes a trough-shaped container means for accommodating a developer fluid, and in that all elements constituting said developing means are arranged at said container means such that the developing means is constructed as an independent completely functional module, and in that said module is arranged in the lower housing section so as to be removable from an end face thereof in the manner of a drawer.

8. A copying arrangement according to claim 1, characterized in that the optical system includes a lamp, means are provided in a first side of said upper housing section for permitting insertion of the lamp therein, socket means are provided on a second side of said upper housing section for receiving said lamp, and in that a resilient contact element is arranged at said upper housing section for normally urging said lamp into said socket means and establishing an electrical connection.

9. A copying arrangement according to claim 8, characterized in that a means for driving said aligning means is provided, and in that said means for selectively actuating said aligning means includes a start button operatively connected with said drive means.

10. A copying arrangement according to claim 9, characterized in that means are provided for operatively connecting said drive means of said aligning means with said feed roller means, whereby said drive means functions as a single drive source for said aligning means and said feed roller means.

11. A copying arrangement according to claim 10, characterized in that said supporting means includes a supporting plate, means are provided for pivotally supporting said plate in said lower housing section so that a front end thereof, as viewed in a transport direction of the sheet of copying paper, is alignable approximately radially with respect to said feed roller means.

12. A copying arrangement according to claim 11, characterized in that said aligning means further includes a rocking lever operatively connected with said supporting plate, a rotatably mounted cam means driven by said drive means and cooperating with said rocking lever for causing selective displacement of said rocking lever, and in that a means is provided for normally biasing said rocking lever into engagement with said cam means.

13. A copying arrangement according to claim 12, characterized in that said biasing means is a spring element arranged between a free end of said rocking lever and a portion of said lower housing section.

14. A copying arrangement according to claim 12, characterized in that a pair of conveyor roller means are provided for transporting the sheet of copying paper in the copying arrangement, said conveyor rollers being arranged in the lower housing section at a spaced position from said feed roller means in a transport direction of the sheet of copying paper, and in that said cam means includes a cam disk, said cam disk and said feed roller means are each provided with a sprocket wheel, and in that said means for operatively connecting said aligning means with said feed roller means includes a chain means arranged between said sprocket wheels, a translation between the sprocket wheels is selected such that one revolution of the cam disk effects a paper transport greater than the spacing between the feed roller means and said pair of conveyor roller means.

15. A copying arrangement according to claim 14, characterized in that a sensor means is provided for controlling the duration of operation of said drive means after said drive means has been activated by said start button.

16. A copying arrangement according to claim 12, characterized in that a braking lever is operatively connected to said rocking lever, said braking lever is associated with a periphery of said cam disk so as to contact said cam disk upon a maximum displacement of said rocking lever by said cam disk.

17. A copying arrangement according to claim 16, characterized in that a plurality of pairs of conveyor roll means are provided in the lower housing section for transporting the copying paper through the copying arrangement, a common drive means is provided for driving said plurality of conveyor roll means, one pair of said conveyor roll means is arranged downstream of the feed roller means as viewed in the paper transport direction, and in that a sensor means is associated with said one pair of conveyor roll means and said common drive means for sensing the arrival of a sheet of copying paper at said one pair of conveyor roll means and activating said common drive means.

18. A copying arrangement according to claim 17, characterized in that a paper severing bar is arranged at the front end of the supporting plate, and in that means are provided for mounting said paper severing bar so as to be arranged approximately radially with respect to said feed roller means.

19. A copying arrangement according to claim 18, characterized in that said paper severing bar is provided with corner separating means cooperable with the stack of copying paper arranged on said supporting plate.

20. A copying arrangement according to claim 19, characterized in that said paper severing bar mounting means mounts said paper severing bar so as to be movable approximately radially with respect to the feed roller means.

21. A copying arrangement according to claim 19, characterized in that guide means are arranged at said supporting plate for receiving a cassette accommodating a stack of copying paper, and in that said cassette is open at least in an area of said paper severing bar.

22. A copying arrangement according to claim 21, characterized in that resilient means are arranged at said supporting plate at least in the area of an end facing the feed roller means for compressing the stack of copying paper.

23. A copying arrangement according to claim 22, wherein said resilient means includes at least two spaced lateral spring holders arranged on said supporting plate.

24. A copying arrangement according to claim 22, characterized in that means are provided for pivotally mounting said upper housing section to said lower housing section such that said upper housing section may be pivoted in an upward direction to an open position.

25. A copying arrangement according to claim 24, characterized in that said means for pivotally mounting said upper housing section to said lower housing section includes a pivot axle extending transversely to a transport direction of the sheet of copying paper, said pivot axle being arranged at an end of the housing at which a completed copy issues.

26. A copying arrangement according to claim 25, characterized in that said pivot axle is arranged in an area of the developing means.

27. A copying arrangement according to claim 26, characterized in that said developing means is constructed as an independent completely functional module removable from said lower housing section.

28. A copying arrangement according to claim 27, characterized in that means are provided for interrupting a supply of current from an electrical supply line to the copying arrangement upon a pivoting of the upper housing section into an open position.

29. A copying arrangement according to claim 9, characterized in that the corona discharge means includes a U-shaped corona housing means for accommodating wires connected to a voltage source, and a baffle means connected to ground arranged oppositely to an open side of said U-shaped corona housing means.

30. A copying arrangement according to claim 29, characterized in that the lower housing section includes a pair of spaced side walls, slotted guide means open at the top are provided in said side walls for receiving said corona housing means, and in that means are arranged at the upper housing section for urging said corona housing means toward said baffle means.

31. A copying arrangement according to claim 30, further including a high voltage rectifier means associated with said corona discharge means, characterized in that the high voltage rectifier means is accommodated in said upper housing section, said urging means includes weighting elements having resilient contact elements, and in that said resilient contact elements engage contact means of the corona discharge means when said upper and lower housing sections are in a closed position.

32. A copying arrangement according to claim 31, characterized in that the corona housing means includes an edge means bevelled obliquely in an upward direction so as to guide an incoming sheet of copying paper into said corona housing means.

33. A copying arrangement according to claim 32, characterized in that insulating means are provided at said corona housing means at least at an end thereof opposite said bevelled edge means.

34. A copying arrangement according to claim 33, characterized in that said insulating means includes a layer of insulating material arranged on said corona housing means.

35. A copying arrangement according to claim 33, characterized in that the end of the corona housing means opposite said bevelled edge means is provided with a guide surface, at least one pair of conveyor roll means are provided for conveying a sheet of copying paper away from said corona housing means, said guide surface being arranged at a predetermined inclination with respect to a circumference of one of said pair of conveyor roll means, and in that a sensor means is arranged at said pair of conveyor roll means which senses a sheet of copying paper exiting from said corona discharge means and activates a drive mechanism of said copying arrangement.

36. A copying arrangement according to claim 29, characterized in that the developing means includes a trough-shaped container means for accommodating a developer fluid, and in that all elements constituting said developing means are arranged at said container means such that the developing means is constructed as an independent completely functional module, and in that said module is arranged in the lower housing section so as to be removable from an end face thereof in the manner of a drawer.

37. A copying arrangement according to claim 36, characterized in that the lower housing section includes a bottom wall and supporting means mounted thereon, and in that the container means is provided on an underside thereof with a transverse rib having a height corresponding approximately to a thickness of the bottom wall of the lower housing section and a height of the supporting means mounted thereon, said transverse rib being arranged in an area of an end face of said container means.

38. A copying arrangement according to claim 37, characterized in that an indentation means is arranged at a bottom of the container means in an area of said transverse rib for accommodating a connecting nipple communicating with an interior of the container means, and in that a hose means is provided at the connecting nipple for permitting a draining of the developing fluid.

39. A copying arrangement according to claim 38, characterized in that guide rib means are arranged at the container means for guiding the movement of a sheet of copying paper therethrough, said guide means defining a curved guide path for the copying paper, and in that a guide roller means is associated with said guide rib means and is immersed in the developer fluid.

40. A copying arrangement according to claim 39, characterized in that at least one pair of conveyor roll means are arranged in the lower housing section for transporting a sheet of copying paper from said corona discharge means to the exposure station means, and in that at least one further pair of conveyor roll means are arranged in the lower housing section for conveying a sheet of copying paper from the exposure station means to the guide rib means of said container means, and in that said guide rib means are initially inclined downwardly at an end of said container means disposed nearest said further pair of conveying roll means so as to extend beneath said guide roll means and are inclined upwardly from an area disposed downstream of said guide roll means as viewed in the copying paper transport direction.

41. A copying arrangement according to claim 40, characterized in that said guide roll means is constructed as an electrode means for effecting a voltage gradient to a charged side of the copying paper so as to improve a precipitation of toner material in the developer fluid.

42. A copying arrangement according to claim 41, characterized in that the guide roll means is provided with a surface having a pyramidal pattern.

43. A copying arrangement according to claim 39, characterized in that storage means is arranged at said container means for storing a quantity of developer fluid, means are provided for mounting said storage means so as to cover a large-area of said container means to inhibit evaporation of the developer fluid therefrom, and in that a valve means is arranged at said storage means such that a free end of said valve means is immersed in the developer fluid.

44. A copying arrangement according to claim 43, characterized in that a baffle means is arranged at an inlet zone of said container means so as to cover at least a portion of said guide rib means for inhibiting a spilling of developer fluid from said container means.

45. A copying arrangement according to claim 44, characterized in that an overflow trough means is arranged at least in an area of side walls of said container means and an end wall for accommodating and permitting an evaporation of any excess developer fluid.

46. A copying arrangement according to claim 45, characterized in that at least one pair of squeeze roller means are arranged at an exit zone of said developing means, at least one pair of drying roll means are arranged upstream of said squeeze roller means, means are provided in side walls of said container means for mounting said squeeze roller means and said drying roll means in said container means, and in that means are provided on at least one of said squeeze roller means and said drying roll means for automatically engaging a drive mechanism of the copying arrangement when said container means is inserted into said lower housing section.

47. A copying arrangement according to claim 46, characterized in that said means for automatically engaging a drive mechanism includes at least one gear wheel operatively connected with at least one of said squeeze roller means and said drying roll means, and a further gear wheel driven by the drive mechanism of the copying arrangement mounted at the lower housing section.

48. A copying arrangement according to claim 46, characterized in that means are arranged in the container means for stirring the developer fluid, and in that means are provided for operatively connecting said stirring means to one of said squeeze roller means and said drying roll means so as to drive said stirring means.

49. A copying arrangement according to claim 48, characterized in that said stirring means is a star roller arranged adjacent an exit zone of said guide rib means.

50. A copying arrangement according to claim 48, characterized in that said means for operatively connecting one of said squeeze roller means and said drying roll means to said stirring means includes a resilient member arranged between said stirring means and one of said squeeze roller means and said drying roll means.

51. A copying arrangement according to claim 50, characterized in that said resilient means is a coil spring looped in the manner of a strip about said stirring means and one of said squeeze roller means and said drying roll means.

52. A copying arrangement according to claim 46, characterized in that spring means are provided for normally respectively urging said pair of squeeze roller means and said drying roll means toward one another, each of said spring means having a first end looped around pin means arranged on side walls of the container means and exerting a load bearing on the respective pair of squeeze roller means and drying roll means, and a second end fixedly mounted in a wall of the container means.

53. A copying arrangement according to claim 39, characterized in that said guide roll means is constructed as an electrode means for effecting a voltage gradient to a charged side of the copying paper so as to improve a precipitation of toner material in the developer fluid.

54. A copying arrangement according to claim 39, characterized in that the guide roll means is provided with a surface having a pyramidal pattern.

55. A copying arrangement according to claim 36, characterized in that the optical system includes a lamp, means are provided in a first side of said upper housing section for permitting insertion of the lamp therein, socket means are provided on a second side of said upper housing section for receiving said lamp, and in that a resilient contact element is arranged at said upper housing section for normally urging said lamp into said socket means and establishing an electrical connection.

56. A copying arrangement according to claim 55, characterized in that means are provided for adjusting the tension on said resilient contact element.

57. A copying arrangement according to claim 56, characterized in that said tension adjusting means includes a knurled-head screw means securing said contact element to an insulating member arranged at the upper housing section.

58. A copying arrangement according to claim 55, characterized in that the exposure carriage means forms at least a portion of a top wall of said upper housing section and includes a glass plate, means are provided for mounting said glass plate at said upper housing section, a telescoping means is arranged along a wall of the upper housing section and operatively connected with said glass plate mounting means for guiding a first end of said glass plate, and a guide track means is arranged along an opposite wall of said upper housing section for guidingly mounting a second end of said glass plate.

59. A copying arrangement according to claim 58, characterized in that said guide track means is constructed as a sliding track fashioned of a synthetic resinous material.

60. A copying arrangement according to claim 59, characterized in that said sliding track includes a blade-shaped tipped portion directly engageable with said glass plate.

61. A copying arrangement according to claim 60, characterized in that said glass plate mounting means includes a profiled strip detachably connected to said telescoping means.

62. A copying arrangement according to claim 61, characterized in that a cover means is mounted at said profiled strip for selectively covering and uncovering said glass plate.

63. A copying arrangement according to claim 62, characterized in that said profiled strip includes a rim, and in that said cover means is a rubber plate mounted so as to be pivotable about said rim.

64. A copying arrangement according to claim 62, characterized in that an adhesive is provided for securing said glass plate and said rubber plate to said profiled strip.

65. A copying arrangement according to claim 64, characterized in that said telescoping means includes a first part fixedly secured to a wall of the upper housing section and at least one second part connected to said profiled strip and displaceably mounted with respect to said first part, and in that a displaceable driving lever is connected to said second part so as to cause selective displacement of said exposure carriage means.

66. A copying arrangement according to claim 65, characterized in that a chain drive means is arranged in said upper housing section and is operatively connected with said driving lever so as to cause selective displacement thereof.

67. A copying arrangement according to claim 66, characterized in that said chain drive means includes two spaced sprocket wheels rotatably mounted at said upper housing section and an endless chain arranged between said two sprocket wheels, means are provided for pivotally connecting said upper housing section to said lower housing section, one of said sprocket wheels is coaxially mounted with respect to said pivot axle, and in that means are provided for operatively connecting said chain drive means to a drive mechanism of the copying arrangement.

68. A copying arrangement according to claim 67, characterized in that said endless chain extends in parallel to a top side of the upper housing section.

69. A copying arrangement according to claim 68, characterized in that a slot is provided in said driving lever extending at a right angle to a conveying direction of said endless chain, and in that an entrainment pin means is arranged on said endless chain for engagement with said slot.

70. A copying arrangement according to claim 69, characterized in that in an initial position, said slot is aligned tangentially with one of said sprocket wheels of said chain drive means.

71. A copying arrangement according to claim 70, characterized in that a switching cam means is arranged on said endless chain and cooperates with a switch means for deactivating at least the drive means of said driving lever.

72. A copying arrangement according to claim 58, characterized in that said glass plate mounting means includes a profiled strip detachably connected to said telescoping means.

73. A copying arrangement according to claim 72, characterized in that a cover means is mounted at said profiled strip for selectively covering and uncovering said glass plate.

74. A copying arrangement according to claim 73, characterized in that said telescoping means includes a first part fixedy secured to a wall of the upper housing section and at least one second part connected to said profiled strip and displaceably mounted with respect to said first part, and in that a displaceable driving lever is connected to said second part so as to cause selective displacement of said exposure carriage means.

75. A copying arrangement according to claim 74, characterized in that a chain drive means is arranged in said upper housing section and is operatively connected with said driving lever so as to cause selective displacement thereof.

76. A copying arrangement according to claim 75, characterized in that said chain drive means includes two spaced sprocket wheels rotatably mounted at said upper housing section and an endless chain arranged between said two sprocket wheels, means are provided for pivotally connecting said upper housing section to said lower housing section, one of said sprocket wheels is coaxially mounted with respect to said pivot axle, and in that means are provided for operatively connecting said chain drive means to a drive mechanism of the copying arrangement.

77. A copying arrangement according to claim 76, characterized in that a slot is provided in said driving lever extending at a right angle to a conveying direction of said endless chain, and in that an entrainment pin means is arranged on said endless chain for engagement with said slot.

78. A copying arrangement according to claim 6, characterized in that said interrupting means is a circuit breaker interposed between said upper housing section and said lower housing section.

79. A copying arrangement which includes a housing means, a paper feeder means for feeding a sheet of copying paper upon which an image is to be transferred, a corona discharge means, an exposure station means associated with an optical system for transferring an image of an original arranged on an exposure carriage means, and a developing means arranged downstream of the exposure station means, characterized in that said housing means includes an upper housing section and a lower housing section, said lower housing section is open toward the top and accommodates at least the paper feeding means, the corona discharge means, the exposure station means and the developing means, the upper housing section accommodates at least the exposure carriage means and the optical system with said upper housing section being removable so as to uncover an entire flow path of the copying paper, a plurality of pairs of conveyor roll means are provided in the lower housing section for transporting the copying paper through the copying arrangement, a common drive means is provided for driving said plurality of conveyor roll means, one pair of said conveyor roll means is arranged downstream of the feed roller means as viewed in the paper transport direction, and in that a sensor means is associated with said one pair of conveyor roll means and said common drive means for sensing an arrival of a sheet of copying paper at said one pair of conveyor roll means and activating said common drive means.

80. A copying arrangement, which includes a housing means, a paper feeder means for feeding a sheet of copying paper upon which an image is to be transferred, a corona discharge means, an exposure station means associated with an optical system for transferring an image of an original arranged on an exposure carriage means, and a developing means arranged downstream of the exposure station means, characterized in that said housing means includes an upper housing section and a lower housing section, said lower housing section is open toward the top and accommodates at least the paper feeding means, the corona discharge means, the exposure station means and the developing means, the upper housing section accommodates at least the exposure carriage means and the optical system with said upper housing section being removable so as to uncover the entire flow path of the copying paper, and in that the corona discharge means includes a U-shaped corona housing means for accommodating wires connected to a voltage source, and a baffle means connected to ground arranged oppositely to an open side of said U-shaped corona housing means.

81. A copying arrangement according to claim 80, characterized in that the developing means includes a trough-shaped container means for accommodating a developer fluid, and in that all elements constituting said developing means are arranged at said container means such that the developing means is constructed as an independent completely functional module, and in that said module is arranged in the lower housing section so as to be removable from an end face thereof in the manner of a drawer.

82. A copying arrangement according to claim 81, characterized in that the optical system includes a lamp, means are provided in a first side of said upper housing section for permitting insertion of the lamp therein, socket means are provided on a second side of said upper housing section for receiving said lamp, and in that a resilient contact element is arranged at said upper housing section for normally urging said lamp into said socket means and establishing an electrical connection.

83. A copying arrangement according to claim 82, characterized in that the exposure carriage means forms at least a portion of a top wall of said upper housing section and includes a glass plate, means are provided for mounting said glass plate at said upper housing section, a telescoping means is arranged along a wall of the upper housing section and operatively connected with said glass plate mounting means for guiding a first end of said glass plate, and a guide track means is arranged along an opposite wall of said upper housing section for guidingly mounting a second end of said glass plate.

84. A copying arrangement which includes a housing means, a paper feeder means for feeding a sheet of copying paper upon which an image is to be transferred, a corona discharge means, an exposure station means associated with an optical system for transferring an image of an original arranged on an exposure carriage means and a developing means arranged downstream of the exposure station means, characterized in that said housing means includes an upper housing section and a lower housing section, said lower housing section is open toward the top and accommodates at least the paper feeding means, the corona discharge means, the exposure station means and the developing means, the upper housing section accommodates at least the exposure carriage means and the optical system with said upper housing section being removable so as to uncover an entire flow path of the copying paper, the exposure carriage means forms at least a portion of a top wall of said upper housing section and includes a glass plate, means are provided for mounting said glass plate at said upper housing section, a telescoping means is arranged along a wall of the upper housing section and is operatively connected with said glass plate mounting means for guiding a first end of said glass plate, and a guide track means is arranged along an opposite wall of said upper housing section for guidingly mounting a second end of said glass plate.

* * * * *

UNITED STATES PATENT AND TRADEMARK OFFICE

CERTIFICATE OF CORRECTION

PATENT NO. : 4,180,319

DATED : December 25, 1979

INVENTOR(S) : Heinrich Kaufmann and Kurt Moser

It is certified that error appears in the above—identified patent and that said Letters Patent is hereby corrected as shown below:

On the cover sheet item (73) Assignee should read

-- Fa. Develop KG, Dr. Eisbein & Co. --.

Signed and Sealed this

*Ninth* Day of *December 1980*

[SEAL]

*Attest:*

SIDNEY A. DIAMOND

*Attesting Officer*

*Commissioner of Patents and Trademarks*